US005432583A

United States Patent [19]

Ishikawa et al.

[11] Patent Number: 5,432,583

[45] Date of Patent: Jul. 11, 1995

[54] REPLENISHER SUPPLYING METHOD AND REPLENISHER SUPPLYING APPARATUS

[75] Inventors: Takatoshi Ishikawa; Ken Kawada, both of Kanagawa, Japan

[73] Assignee: Fuji photo Film Co., Ltd., Kanagawa, Japan

[21] Appl. No.: 127,370

[22] Filed: Sep. 28, 1993

[30] Foreign Application Priority Data

Sep. 29, 1992 [JP] Japan ..... 4-260225

[51] Int. Cl.[6] ..... G03D 3/02

[52] U.S. Cl. ..... 354/324

[58] Field of Search ..... 354/298, 324; 222/129, 222/64–66

[56] References Cited

U.S. PATENT DOCUMENTS 5,184,164 2/1993 Kose et al. ..... 354/324
5,307,107 4/1994 Nozowa et al. ..... 354/324

FOREIGN PATENT DOCUMENTS 53108335 8/1978 Japan .
6455562 3/1989 Japan .
5134666 6/1991 Japan .

*Primary Examiner*—D. Rutledge

*Attorney, Agent, or Firm*—Sughrue, Mion, Zinn, Macpeak & Seas; Turner Richard C.; John F. Rabena

[57] ABSTRACT

A replenisher supplying apparatus includes a plurality of cartridges, a plurality of stock tanks, a plurality of supply devices for supplying the component agents stored in the stock tanks to a processing tank, communication devices for supplying the component agents filled in the cartridges to the stock tanks, detection devices for detecting whether the quantity of each of the component agents stored in the stock tanks has decreased to be equal to or less than a predetermined level, and a control device for operating, at a time when it is judged by the detection devices that the quantity of a component agent stored in one of the stock tanks has decreased to be equal to or less than the predetermined level, and operating one of said supply devices so as to reduce the quantity of a component agent stored in another stock tank to a level equal to or less than the predetermined level, and operating said communication devices so as to supply the component agents to the stock tanks. Since the plural cartridges can be exchanged at one time, the frequency of exchange operation of the cartridges can be reduced, whereby work efficiency is increased.

21 Claims, 8 Drawing Sheets

REPLENISHER SUPPLYING METHOD AND REPLENISHER SUPPLYING APPARATUS

BACKGROUND OF THE INVENTION

1. Field of the Invention

The present invention relates to a method of supplying a replenisher, and a replenisher supplying apparatus using the method.

2. Description of the Related Art

Photosensitive materials which have been exposed to the light to form images thereon are processed by being successively immersed in various processing solutions such as a developing solution, fixing solution and washing water which are respectively stored in processing tanks. Performance of these processing solutions deteriorates as the quantity of the processed photosensitive materials increases, and as time passes. Therefore, in an automatic developing machine or the like, replenishers are automatically supplied to the corresponding processing tanks, in accordance with the quantity of the processed photosensitive materials so that the performance of each processing solution remains constant.

There are some replenishers which are prepared by blending plural kinds of compound liquids (hereinafter referred to as "component agents"). A method of supplying such replenishers to processing tanks has been proposed (Japanese Patent Application Laid-open (Kokai) No. Sho-64-55562). In the method, a supplying apparatus of a cartridge type is used in which a blended replenisher filled in a cartridge is pumped out with a pump or the like in portions and fed to a processing tank. The above-mentioned apparatus, however, involves a drawback in that when the component agents of plural kinds remain mixed in the cartridge for a prolonged period of time, the component agents of different kinds are chemically reacted with each other so that the compounds of the component agents precipitate, which causes deterioration of the quality of the component agents.

Further, since a pipe or the like are inserted into the cartridge for pumping out the mixture, the supplying apparatus is required to have a special structure for preventing the component agents which remain in the pipe or the like from dispersing when the cartridge is exchanged with a new one.

In relation to this, another type of supplying apparatus has been proposed (Japanese Utility Model Application Laid-open (Kokai) No. Sho-53-108335), which prevents undesirable leakage of liquid which occurs at the time of exchanging cartridges. This apparatus, however, has disadvantages in that the operation for taking out a replenisher from the cartridge is troublesome, it requires a special operation, and the accuracy in taking out the replenisher decreases.

In the meantime, a method has been proposed (Japanese Patent Application Laid-open (Kokai) No. Hei-3-134666) for preventing the above-mentioned precipitation of the components. In the method, plural kinds of component agents are filled in different cartridges, respectively, and the component agents are temporarily stored in stock tanks disposed for the corresponding cartridges for being pumped out to be supplied to a processing tank. In this method of replenishing a processing solution, the respective component agents are pumped out so that each of the component agents is supplied to the processing tank at a predetermined rate.

In many cases, the pumping capacity of the pumps slightly differs from each other. When the quantity of a component agent stored in one of stock tanks decreases to be less than a predetermined amount, a supply of the component agents is provided from the corresponding cartridge, and when the cartridge becomes empty, the cartridge is exchanged with a new one. However, since the pumping capacity differs, as mentioned above, the quantities of the replenished component agents vary, which causes a varied quality of the photographs. Moreover, the timing at which the quantity of each stored in the stock tank decreases to be equal to or less than the predetermined level differs. This means that the timing at which each of the cartridges is to be exchanged occurs differently. Therefore, the exchange operation of the cartridges must be carried out frequently whenever a cartridge reaches the time for being exchanged.

Further, since it is necessary that processing such as development in the processing tank be temporarily interrupted when any one of the cartridges is exchanged, the work efficiency decreases as the processing is interrupted every time a cartridge is exchanged if the timings for exchange are different from each other on the respective cartridges, as mentioned above.

SUMMARY OF THE INVENTION

Taking the above-mentioned facts into consideration, the present invention provides a method of supplying a replenisher which is capable of reducing the frequency of exchange operation of cartridges, allowing the operator to exchange the cartridges during the operation of processing, and increasing the supply accuracy.

Further, another object of the present invention is to provide a replenisher supplying apparatus which is capable of reducing the frequency of exchange operations of cartridges, and increasing the work efficiency.

According to one aspect of the present invention, there is provided a method of supplying a replenisher to a processing tank by supplying thereto plural kinds of component agents which form the replenisher when blended. In the method, a plurality of cartridges are set above a plurality of stock tanks for storing the plural kinds of component agents, the cartridges being filled with the component agents to be stored in the stock tanks. When the quantity of a component agent stored in one of the stock tanks has decreased to be equal to or less than a first predetermined level, a component agent stored in another one of the stock tanks is supplied to the processing tank until the quantity of the component agent stored therein decreases to be equal to or less than a second predetermined level, communication being established between each of the stock tanks and its corresponding cartridge disposed above the stock tank so that the component agents filled in the cartridges are supplied to the corresponding stock tanks.

In the preferred embodiments of the present invention, the first and second predetermined levels are the same. However, the first and second predetermined levels may be determined to be different from each other.

Accordingly, when the quantity of a component agent stored in one of the stock tanks decreases to be equal to or less than the corresponding predetermined level, a component agent remaining in another stock tank is compulsorily supplied to the processing tank, so that the quantities of the component agents stored in the stock tanks are mostly equalized. After the establishment of such a condition, communication is established between each of the stock tanks and corresponding one of the cartridges to supply the component agents to the corresponding stock tanks. Therefore, timings for exchanging the respective cartridges are made to coincide with each other. Accordingly, the plurality of cartridges can be exchanged at one time so that the frequency of exchange operation of the cartridges is reduced, thereby improving work efficiency.

Further, in a case in which the quantity of only a component agent in a particular stock tank has decreased to be equal to or less than the predetermined level due to difference in the capacity of the pumps or the like, the ratio of the quantities of the component agents supplied to the processing tank deviates from a predetermined ratio. However, compensation is made so that the ratio of the quantities of the component agents supplied to the processing tank coincides with the predetermined ratio, because the component agent remaining in another stock tank is compulsorily fed to the processing tank. Further, since a plurality of component agents of different kinds are filled in different cartridges, and are then stored in the different stock tanks, respectively, components of the component agents are prevented from precipitating, thereby stabilizing the qualities of the component agents.

Although the above-mentioned predetermined level as a limit for the quantities of the component agents in the stock tanks may be freely set, it is preferable to set the predetermined level to a value less than 2 liters, more preferably from 100 to 1500 milliliters, because of easy control and proper remaining amounts.

Further, since the cartridges are set above the stock tanks, and the component agents are pumped out from their bottom portions by the pumps to be supplied to the processing tank, there is no possibility that air enters the supply path, so that the supply of the replenisher is stably carried out. On the contrary, when the component agents are supplied directly from the cartridges, a drawback arises in that air enters the supply path when the cartridges are exchanged. Since the quantities of the component agents supplied to the processing tank drastically fluctuate in such a case, it is difficult to stably carry out the replenishment of the component agents.

An example incorporating one aspect of the present invention is a method of supplying a replenisher composed of plural kinds of component agents, in which proper developing processing is carried out when each component agent is entirely used. To ensure proper developing processing, when the quantity of a component agent stored in one of the stock tanks decreases to be equal to or less than a predetermined level during continuous processing, a component agent remaining in another stock tank is entirely supplied to the processing tank.

In an embodiment of the present invention, it is preferable to use liquid level sensors for detecting the height of the surface of each of the component agents so as to detect that the quantity of a component agent stored in any one of the stock tanks has decreased to be equal to or less than the predetermined level and to supply the component agent stored in another stock tank to the processing tank until the quantity of the component agent stored therein decreases to be equal to or less than the predetermined level. According to the method of the present invention, when the component agent in any one of the stock tanks has been decreased to be equal to or less than the corresponding predetermined level, a liquid level sensor detects such a condition to finally allow the operator to exchange the plurality of cartridges at a time. Therefore, it becomes possible to reduce the frequency of exchange operation of the cartridges even through the capacity of the supply means such as a pump for supplying a component agent from a stock tank to the processing tank differs from each other, whereby work efficiency is increased.

According to another aspect of the present invention, there is provided a replenisher supplying apparatus including a plurality of cartridges filled with plural kinds of component agents which are to be blended to prepare a replenisher for being supplied to a processing tank; a plurality of stock tanks for storing the plural kinds of component agents, respectively, above which the cartridges are disposed, each of the cartridges being filled with a component agent to be stored in corresponding one of the stock tanks; a plurality of supply means provided for the corresponding stock tanks for supplying the component agents stored in the respective stock tanks to the processing tank; communication means for establishing communication between the stock tanks and the cartridges disposed above the corresponding stock tanks, respectively, so that the component agents filled in the cartridges are supplied to the corresponding stock tanks; detection means for detecting whether the quantity of each of the component agents stored in the corresponding stock tanks has decreased to be less than or equal to a corresponding predetermined level; and control means which operates at a time when it is judged by said detection means that the quantity of a component agent stored in one of the stock tanks has decreased to be less than or equal to the corresponding predetermined level of said one of the stock tanks, said supply means so as to reduce the quantity of the component agent stored in another stock tank to a level less than or equal to the corresponding predetermined level of said another stock tank, and operates said communication means to supply the component agents to the corresponding stock tanks.

Accordingly, timings for exchanging the plural cartridges are made to coincide with each other. The plurality of cartridges can therefore be exchanged at one time so that the frequency of exchange operation of the cartridges is reduced, whereby work efficiency is increased. Further, the ratio of the quantities of the respective component agents supplied to the processing tank is compensated for so as to coincide with a predetermined ratio. This realizes an effect that the qualities of the component agents are stabilized.

Further, it is preferable that the plural cartridges to be set to the plural stock tanks are integrally formed. Since timings of exchanging the plural cartridges are made to coincide with each other, as mentioned above, all the plural cartridges are exchanged at one time. If the plurality of cartridges are integrally formed, the plurality of cartridges can be exchanged by one single action.

In a concrete example of the present invention, it is preferable that the communication means is comprised of a meltable portion formed on each of the cartridges and a heater for each of the cartridges which melts the meltable portion. The meltable portions of the respective cartridges are melted by the heaters to establish communication between each of the cartridges and its corresponding stock tank so as to supply the component agents filled in the cartridges to their corresponding stock tanks. According to the apparatus of the present invention, it becomes possible to simultaneously supply the parts agents to the respective stock tanks by simultaneously melting the meltable portions of the cartridges by the heaters. Accordingly, the plural cartridges can be exchanged at one time, which reduces the Frequency of exchange operation of the cartridges, whereby work efficiency is improved.

Further, the component agents filled in the cartridges may be of a concentrated type which is diluted, or of a working-solution type which does not need water for dilution. When a concentrated component agent is used, it is desirable to provide an additional cartridge filled with water for dilution.

The plurality of cartridges which will be filled with component agents and are used in the present invention may have the same capacity (size), or different capacities. However, it is preferable to use cartridges having the same capacity, if the mass production of the cartridges and the supplying apparatus is needed to be considered.

DETAILED DESCRIPTION OF THE PREFERRED EMBODIMENTS

Figure 1:
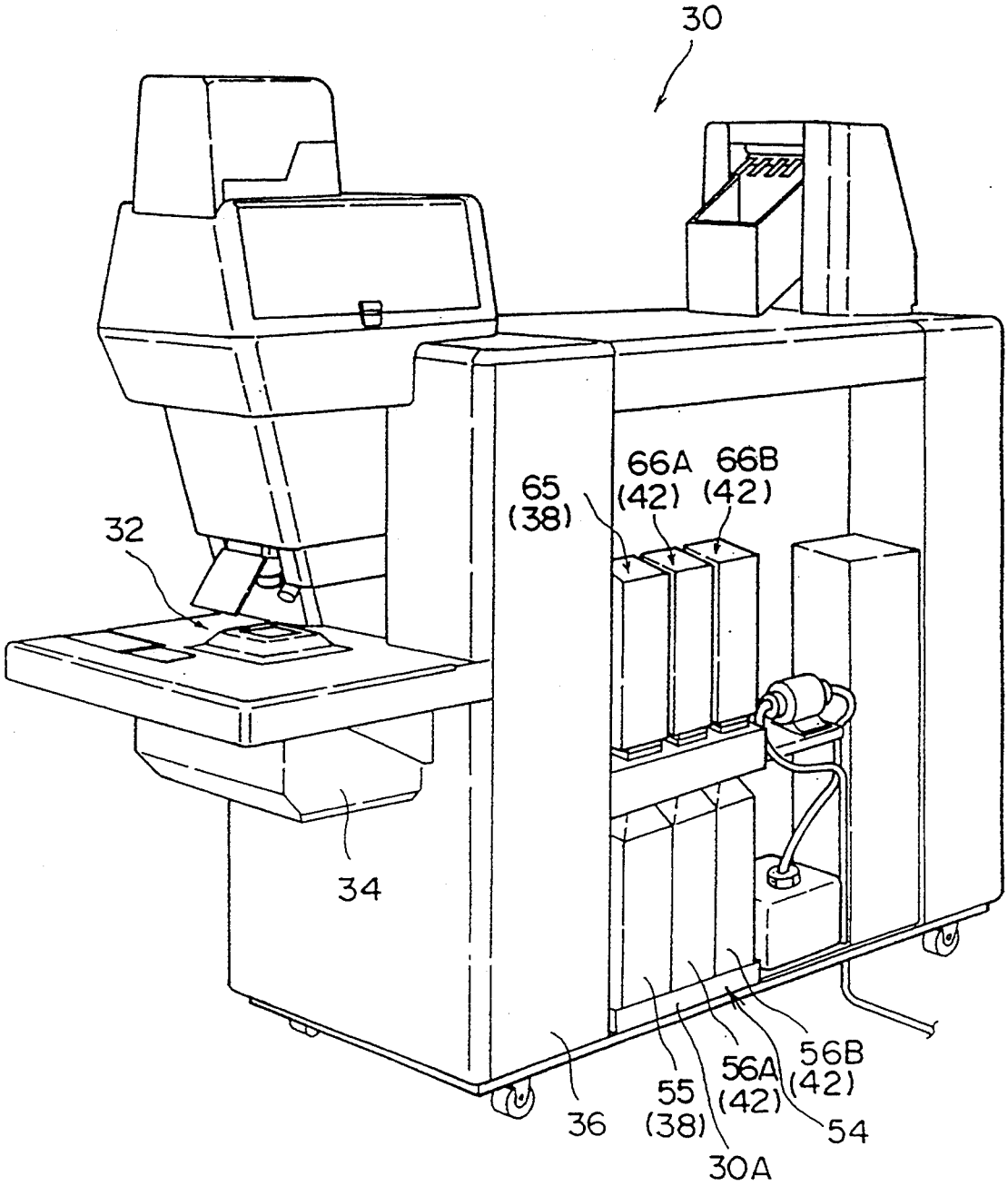
FIG. 1 is a perspective view showing a printer processor according to the present embodiment.

No particular limitation is imposed on the materials which may be used for manufacturing the cartridge of the present invention. Any material including paper, plastic and metal can be used. However, plastic materials having an oxygen permeation coefficient of 50 ml/($m^2$.atm.day) or less are preferred.

The oxygen permeation coefficient can be measured according to the method described in pages 143–145 of the December issue of "$O_2$ Permeation of Plastic Container, Modern Packing" (N. J. Calyan, 1968).

Representative examples of preferable plastic materials include polyvinylidene chloride (PVDC), nylon (NY), polyethylene (PE), polypropylene (PP), polyester (PES), ethylene-vinyl acetate copolymer (EVA), ethylene-vinyl alcohol copolymer (EVAL), polyacrylonitrile (PAN), polyvinyl alcohol (PVA) and polyethylene Cerephthalate (PET). According to the present invention, it is preferable that PVDC, NY, PE, EVA. EVAL and PET be used for reducing oxygen permeability. These materials may be used alone and shaped, or a plural number of materials may be formed into films and laminated one on another (so called laminated film). The cartridge can be provided in various shapes such as bottles, cubes, pillows or the like. In this invention, cubes and analogous shapes are preferred in view of flexibility, easy handling and possibility of reduction in size after use. When laminated films are used. The following structures, but not limited thereto, are particularly preferred.

PE/EVAL/PE
PE/Aluminum foil/PE
NY/PE/NY
NY/PE/EVAL
PE/NY/PE/EVAL/PE
PE/NY/PE/PE/PE/NY/PE
PE/$SiO_2$ film/PE
PE/PVDC/PE
PE/NY/Aluminum foil/PE
PE/PP/Aluminum foil/PE
NY/PE/PVDC/NY
NY/EVAL/PE/EVAL/NY
NY/PE/EVAL/NY
NY/PE/PVDC/NY/EVAL/PE
PP/EVAL/PE
PP/EVAL/PP
NY/EVAL/PE
NY/Aluminum foil/PE
Paper/Aluminum foil/PE
Paper/PE/Aluminum foil/PE
PE/PVDC/NY/PE
NY/PE/Aluminum foil/PE
PET/EVAL/PE
PET/Aluminum foil/PE
PET/Aluminum foil/PET/PE The thickness of the above-mentioned laminated films is in the range from 5 to 1500 microns and preferably from 10 to 1000 microns. The capacity of the formed container is from 100 milliliters to 20 liters, preferably, 500 milliliters to 10 liters. The above container (cartridge) may be housed in a casing formed of corrugated cardboard or plastic, or may be integrally formed with the casing.

The processing solution cartridge of the present invention may be filled with various kinds of processing solutions. For example, color developing solutions, monochrome developing solutions, bleaching solutions, conditioner, reversal processing solutions, fixing solutions, bleaching/fixing solutions and stabilizers are mentioned as examples of the processing solutions. For providing plural kinds of component agents, it is preferable that monochrome developing solutions, color developing solutions and bleaching/fixing solutions be used, among which, use of bleaching/fixing solutions is particularly preferred.

The color developing solutions used in the present invention are preferably alkaline aqueous solutions, whose main component is a color developing agent of the aromatic primary amine type. While aminophenol compounds are also useful as the color developing agent, p-phenylenediamine type compounds are preferred. Typical examples of p-phenylenediamines include 3-methyl-4-amino-N,N-diethylaniline, 4-amino-N-ethyl-N,N- -hydroxyethylaniline, 3-methyl-4-amino-N-ethyl-N- -hydroxyethylaniline, 3-methyl-4-amino-N-ethyl-N- -methane sulfonamide ethylaniline, 3-methyl-4-amino-N-ethyl-N- -methoxyethylaniline, 3-methyl-4-amino-N-ethyl-N- -hydroxybutylaniline as well as sulfates, hydrochlorides, or p-toluene sulfonates thereof. These compounds may be used in combination with two or more depending on the purpose for which the color developing solution is used.

Color developing solutions generally contain pH buffers such as carbonates, borates and phosphates of alkali metals; and development inhibitors or antifoggants such as bromides, iodides, benzimidazoles, benzthiazoles, and mercapto compounds. Further, the color developing solutions may optionally contain the following: various preservatives such as hydroxylamine, N,N-di(sulfoethyl)hydroxylamine, diethylhydroxylamine, sulfites, hydrazines, phenylsemicarbazides, triethanolamines and catechol disulfonates; organic solvents such as ethylene glycol, and diethylene glycol; development accelerators such as benzyl alcohol, polyethylene glycol, quaternary ammonium salts, and amines; fogging agents such as dye forming couplers, competitive couplers, sodium borohydride; auxiliary developers; thickeners; chelating agents typified by aminopolycarboxylic acid, aminopolyphosphonic acid, alkylphosphonic acid, phosphonocarboxylic acid, inclusive of ethylenediamine tetraacetic acid, nitrilotriacetic acid, diethylenetriamine pentaacetic acid, cyclohexanediamine tetraacetic acid, hydroxyethyl iminodiacetic acid, carboxyethyl iminodiacetic acid, 1-hydroxyethylidene-1,1-diphosphonic acid, nitrilo-N,N,N-trimethylene phosphonic acid, ethylenediamine-N,N,N′,N′-tetramethylene phosphonic acid, ethylenediamine-di(o-hydroxyphenylacetic acid) and their salts.

Generally speaking, the pit of these color developing solutions is in a range of from 9 to 12.

The replenishing amount of these color developing solutions depends on the type of color photograph sensitive material. In general, the amount does not exceed 1 liter per square meter of the sensitive material. It can be made to 300 milliliters or less by reducing the concentration of bromide ions in the replenisher. Preferable amount is 30 to 150 milliliters per square meter. In the case of reducing the replenishing amount, it is preferable to reduce the area of the liquid in the processing tank that has contact with the air so as to prevent the liquid from being evaporated or oxidized. Alternatively, the replenishing amount can be reduced by adopting means for restraining the accumulation of bromide ions in the developer.

The color developing solutions according to the present invention can be divided into two or more components so as to enhance the stability of the solution. Preferably, the solution is divided into two or three components. In case of dividing into two components, one is preferably a developing main agent of p-phenylenediamine type and the other is a buffer agent such as potassium carbonate. In case of dividing into three components, a preservative or a brightening agent are preferably separated to constitute the third component in addition to the mentioned two components. All the components do not necessarily have the identical volume, and they can be separated so that a desired concentration of replenisher can be obtained when all the components are admixed.

The bleaching/fixing solutions used in the present invention contain a bleaching agent and a fixing agent. Bleaching agents to be used are preferably iron (III) complexes of aminopolycarboxylic acids. Preferable examples of aminopolycarboxylic acids include ethylenediamine tetraacetic acid, diethylenetriamine pentaacetic acid, cyclohexanediamine tetraacetic acid, methylimino diacetic acid, 1,3-diaminopropane tetraacetic acid, glycoletherdiamine tetraacetic acid and carboxyethylimino diacetic acid. The concentration of these bleaching agents is from 0.02 to 0.6 mol/liter.

Fixing agents may be thiosulfates, thiocyanates, thioether compounds, thioureas, a large amount of iodine salts, etc. Of these, thiosulfates are generally adopted, and especially, ammonium thiosulfate can be used most widely. As preservatives for the bleaching/fixing agents, sulfites, bisulfites, benzene sulfonates and carbonyl bisulfites are preferred.

The bleaching agents and the fixing agents are preferably supplied as independent and separated components. Bleaching agent components may be optionally added with aminopolycarboxylic acids, pit modifiers, bleaching accelerators or the like besides the mentioned bleaching agents. The preferable pH is from 0.5 to 6.0. Fixing agent components may contain preservatives and pH modifiers in addition to thiosulfates. The preferable pH is from 4 to 9, and especially 5 to 8.

In the present invention, the desilverization step is generally followed by a washing and/or stabilizing step. The amount of water used in the water washing step can be determined depending on the characteristics of the sensitive materials (for example, materials used as a coupler), use, temperature of the washing water, the number of the washing tanks (number of stages), the type of replenishing system such as counter or following current and on other various conditions. Of these conditions, the relationship between the number of washing tanks and the amount of water used in a multistage counter-current system can be obtained by the method described in "Journal of the Society of Motion Picture and Television Engineers", vol. 64, pages 248 to 253 (May 1955 issue).

In accordance with the multistage counter-current system described in the above-mentioned reference, the amount of water required for washing can be substantially reduced. However, due to the increase in the time during which the water stays in the tank, bacteria propagate therein, resulting in the adhesion of suspended matters onto the sensitive material. The processing of color sensitive material according to the present invention can overcome this problem by effectively utilizing a method of reducing calcium and magnesium ions described in Japanese Patent Application Laid-open (Kokai) No. 62-288,838. In this regard, it may be possible to employ germicides such as an isothiazoline compound disclosed in Japanese Patent Application Laid-open (Kokai) No. 57-8,542, thiabendazols, or chlorine type germicides such as chlorinated sodium isocyanide. Further, other germicides including benzotriazol, etc. may be adopted which are described in "Chemistry of Germicides and Mildewcides" by Hiroshi HORIGUCHI, "Degerming, Sterilizing and Mildewcide Techniques" compiled by the Hygienics Society, and "Dictionary of Germicides and Mildewcides" compiled by the Japan Anti-Bacteria/Anti-Mildew Society.

The pH of the washing water for processing sensitive material in accordance with the present invention is in the range of from 4 to 9, and preferably from 5 to 8. The water temperature and the washing time may be set in accordance with the characteristics of the sensitive material used and its use. Generally speaking, the setting may be determined as: 20 seconds to 10 minutes at 15° to 45° C., more preferably, 30 seconds to 5 minutes at 25° to 40° C. Further, the sensitive material used in this invention can be directly processed with a stabilizer instead of washing water. For this stabilizing processing, all the well-known methods disclosed in Japanese Patent Application Laid-open (Kokai) Nos. 57-8,543, 58-14,834 and 60-220,345 can be used. Various chelating agents and mildewcides may also be added to a stabilizing bath.

The overflow liquid resulting from the above-mentioned water washing and/or the replenishment of the stabilizer can be reused in other processes such as desilverization.

The silver halide color sensitive materials used in the present invention may contain, as needed, various 1-phenyl-3-pirazolidones for the purpose of accelerating the color development. Examples of the typical compounds include those disclosed in Japanese Patent Application Laid-open (Kokai) Nos. 56-64,339, 57-144,547 and 58-115,438.

The processing liquids used in the present invention are used at temperatures ranging from 10° to 50° C. In general, the standard temperature falls in the range from 33° to 42° C. However, it is possible to accelerate development by raising the temperature. Conversely, the image quality and the stability of the processing liquids can be improved if processed at a low temperature. To economize on the silver in the sensitive material, cobalt intensification or hydrogen peroxide intensification disclosed in West German Patent No. 2,226,770 or U.S. Pat. No. 3,674,499 may be followed.

It is desirable that the volume of replenisher in each processing step be as small of quantity as possible. The volume of replenisher is preferably from 0.1 to 50 fold, more preferably, from 3 to 30 fold based on the volume of the carried-over liquid from the previous bath per unit area of the sensitized material.

Concerning the developing solutions to be used for developing monochrome sensitizing materials in the present invention, Japanese Patent Application (Kokai) No. Sho-61-226,292, page 66, line 7 to page 68 may be referred to.

Figure 2:
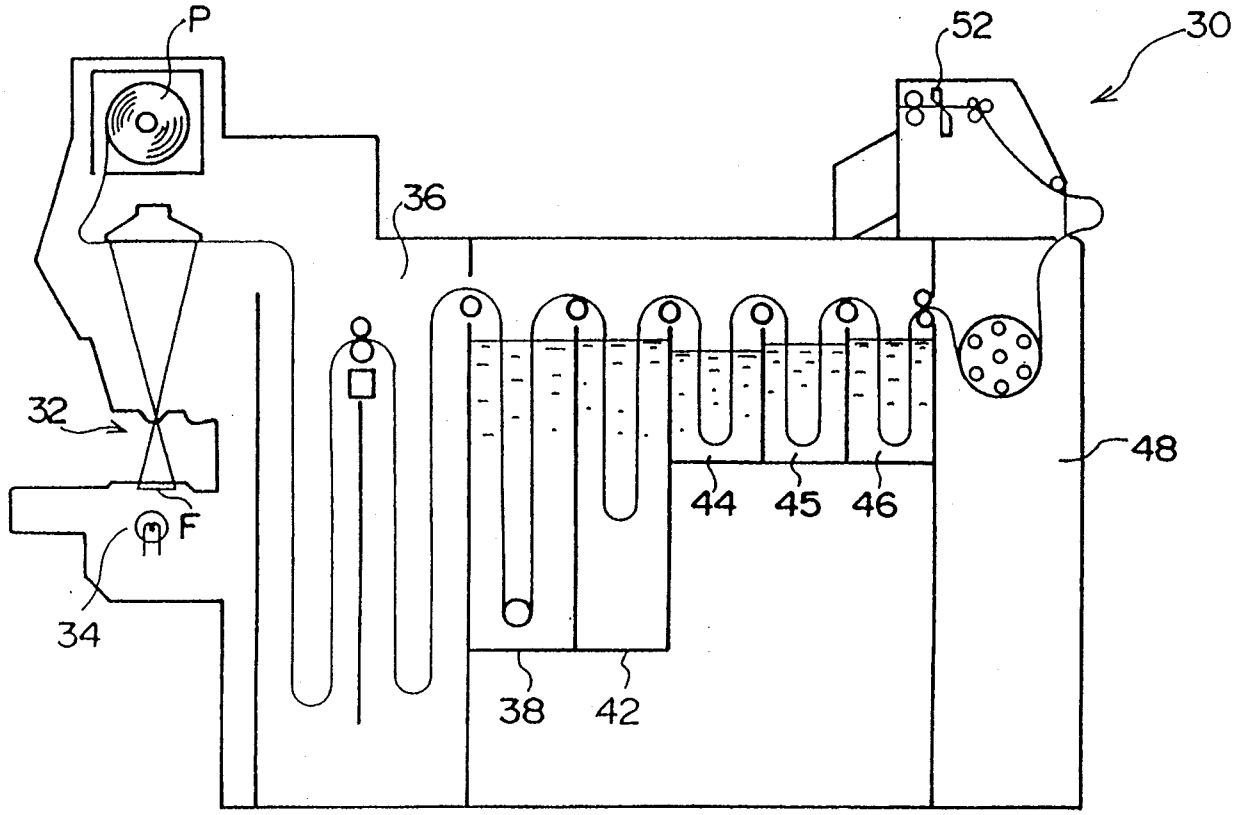
FIG. 2 is a schematic view showing the structure of The printer processor.

The present invention will now be explained in detail with reference to the drawings. FIG. 1 and FIG. 2 show a printer processor 30 to which the present invention is applied. In the printer processor 30, a rolled photographic printing paper P is pulled out to a printing section 32, where the printing paper P is exposed to light from a light source 34 so that images on a negative film F is printed onto the printing paper P. The printing paper P is then successively fed to a color developing tank 38, a bleaching/fixing tank 42 and washing tanks 44, 45 and 46, via a paper reserving section 36. Stored in these processing tanks are a developing solution, a bleaching/fixing solution, a washing solution and the like which have been prepared in advance. Unillustrated conveyer racks are also disposed in the printer processor 30. The photographic printing paper P is passed through the processing tanks while being guided by the conveyer racks, so that the photographic printing paper P is successively immersed into the respective processing solutions for carrying out a series of developing processes. After the series of developing processes, the photographic printing paper P is dried in a drying section 48 and is then cut by a cutter 52 image by image.

As shown in FIG. 1, replenisher stock tanks 55, 56A and 56B are placed on a base 30A of the printer processor 30 at its side portion. These replenisher stock tanks 55, 56A and 56B constitute a part of a replenisher supplying apparatus 54 for supplying a replenisher or component agents to the color developing tank 38 and bleaching/fixing tank 42 of the printer processor 30. Numbers in parentheses indicate the respective replenisher stock tanks and the respective processing tanks to which the replenisher or component agents are supplied from the respective replenisher stock tanks. The present embodiment will now be explained by Focusing on a portion shown in FIG. 3 of the replenisher supplying apparatus 54 which supplies two kinds of component agents to the bleaching/fixing tank 42.

Figure 3:
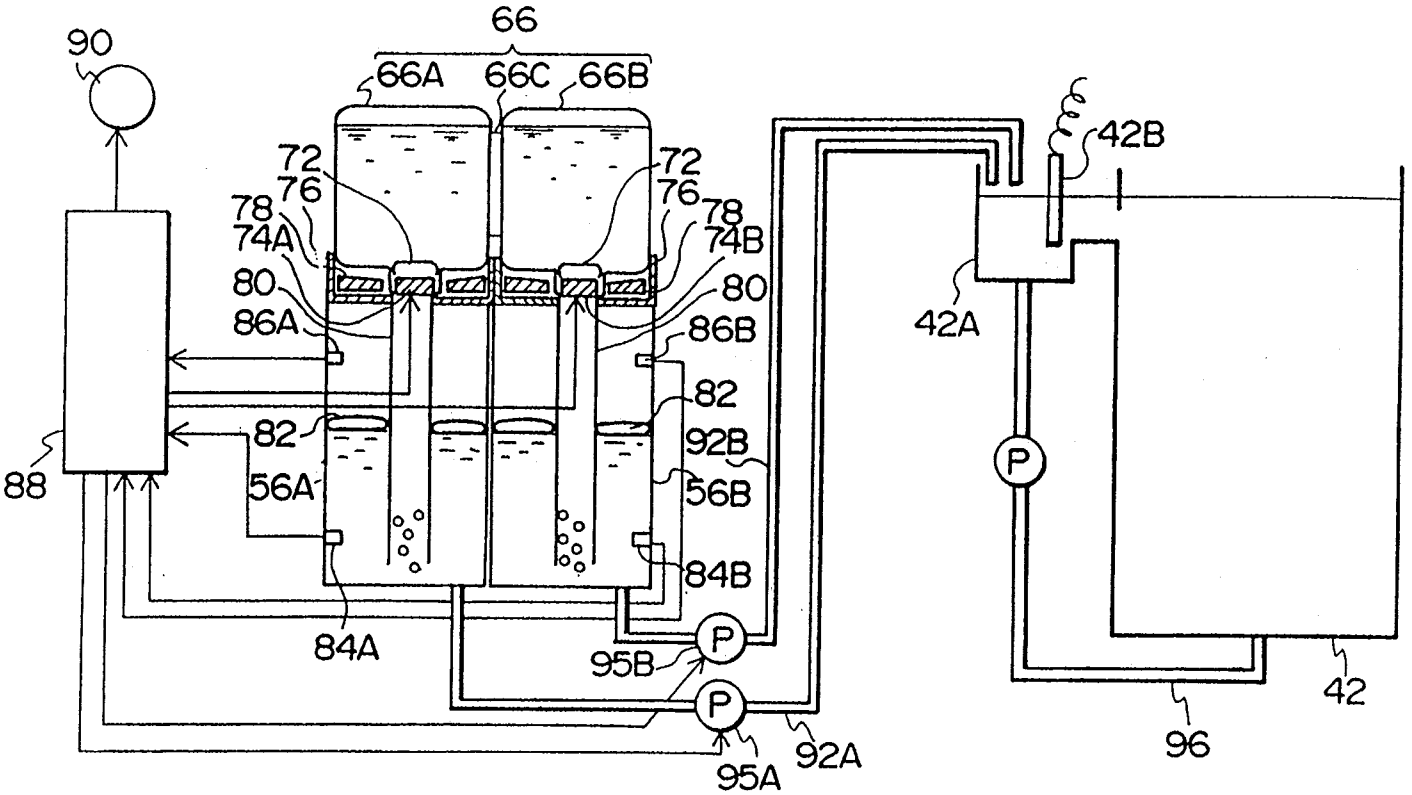
FIG. 3 is a schematic view showing a part of a replenisher supplying apparatus, which supplies component agents to a bleaching/fixing tank.

The two kinds of component agents supplied to the bleaching/fixing agents are a component agent containing an iron (III) complex of aminopolycarboxylic acid (hereinafter referred to as "component agent A" and a component agent containing thiosulfate (hereinafter referred to as "component agent B" As shown in FIG. 3, the two replenisher stock tanks 56A and 56B correspond to the bleaching/fixing tank 42, and the component agent A and the component agent B are stored in the replenisher stock tank 56A and the replenisher stock tank 56B, respectively. The replenisher supplying portion shown in FIG. 3 is arranged to supply the component agent A and component agent B to the bleaching-/fixing tank 42.

As illustrated in FIG. 3, each of the stock tanks 56A and 56B is formed in a rectangular box-like shape having an opening at its upper end. The opening of a box-shape holder member 76 having a bottom is attached to the opening of each stock tank. Disposed inside the replenisher stock tanks 56A and 56B are down-flow pipes 80 whose upper ends penetrate the bottoms of the holder members 76, and whose lower ends extend to positions near the bottom surfaces of the replenisher stock tanks 56A and 56B, respectively. At locations in the vicinity of the respective holder members 76 and adjacent to the upper ends of the down-flow pipes 80, heaters 74A and 74B are disposed.

Figure 4:
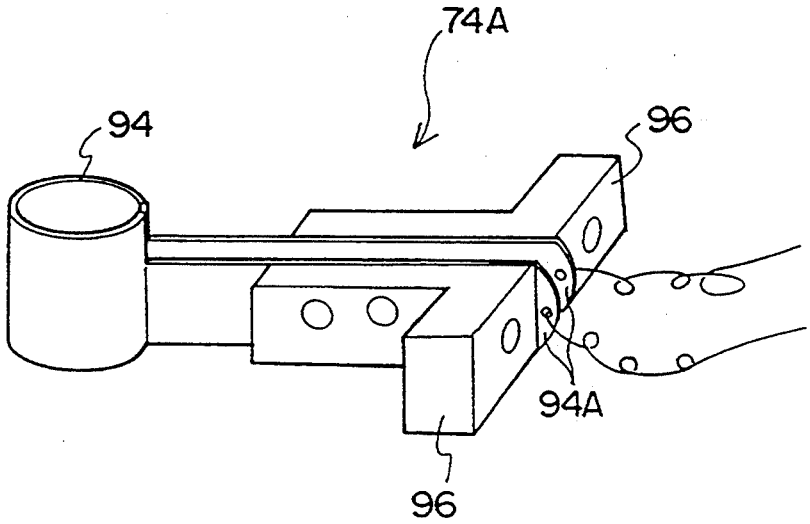
FIG. 4 is a perspective view showing a heater for fusing a cap of a cartridge.

As shown in FIG. 4, the heater 74A is provided with a wing-shaped heat generating portion 94 whose diameter is nearly equal to that of the down-flow pipes 80. Attached to the heat generating portion 94 are holders 96 made of insulating material. The heat generation portion 94 is formed with electrodes 94A. The electrodes 94A are connected to a control circuit 88 (see FIG. 3) which is comprised of a microprocessor and other devices, so that the supply of current to the heater 74A is controlled by the control circuit 88. The heater 74B having a structure similar to that of the heater 74A is also connected to the control circuit 88.

To the holder members 76 of the replenisher stock tanks 56A and 56B, cartridges 66A and 66B of a cartridge tank 66 are attached. The cartridges 66A and 66B are integrally connected with each other via a connection portion 66C to constitute the cartridge tank 66. The holder members 76 are provided with spacers 78, on which the cartridges 66A and 66B are seated when the cartridge tank 66 is attached to the holder members 76, so that the cartridge 66 is held at a predetermined position. The cartridge 66A is filled with the component agent A while the cartridge 66B is filled with the component agent B. Each of the cartridges 66A and 66B is formed with a cap 72 made of polyethylene. The caps 72 of the respective cartridges 66A and 66B are pushed against the heat generating portions 94 of the heaters 74A and 74B when the cartridge tank 66 is attached to the holder members 76.

Further, a first liquid level sensor 84A is attached to the inside wall of the replenisher stock tank 56A so as to be close to the bottom surface thereof and detects the level of the component agent A stored in the replenisher stock tank 56A. A second liquid level sensor 86A similar to the first liquid level sensor 84A is also attached to the inside wall of the replenisher stock tank 56A so as to be close to the holder member 76.

The first liquid level sensor 84A is attached to the stock tank 56A at a position corresponding to a level of the component agent A at the time when the quantity of the component agent A becomes insufficient, namely, when it becomes necessary to cause the component agent A to flow down to the replenisher stock tank 56A. The first liquid level sensor 84A is therefore turned on when the level of the component agent A reaches such a position. On the other hand. The second liquid level sensor 86A is attached to the stock tank 56A at a position slightly below the level of the component agent A when all of the component agent A stored in the cartridge 66A has been supplied to the replenisher stock tank 56A. The first liquid level sensor 84A is therefore turned on when the level of the part agent A reaches such a position.

Similarly, a first level sensor 84B is attached to the inner wall of the replenisher stock tank 56B at the same height as that of the first level sensor 84A, while a second liquid level sensor 86B is attached to the inner wall of the stock tank 56B at the same height as that of the second liquid level sensor 86A. The first liquid level sensor 84B and second liquid level sensor 86B detect the level of the component agent B stored in the replenisher stock tank 56B in a manner similar to the above-mentioned manner. These first liquid level sensors 84A and 84B, and second liquid level sensors 86A and 86B are electrically connected to the control circuit 88. An alarm 90 for instructing an operator to exchange the cartridge tank 66 is also electrically connected to the control circuit 88.

Further, in the replenisher stock tanks 56A and 56B, floating covers 82 float on the surfaces of the component agents A and B stored in the replenisher stock tanks 56A and 56B. Due to the floating covers 82, very little of the component agents A and B in the replenisher stock tanks 56A and 56B comes in contact with air, thereby mostly eliminating the deterioration of the component agents A and B due to the air.

The bottom surface of the replenisher stock tank 56A is penetrated by one end of a supply pipe 92A, to which a pump 95A is disposed in an intermediate portion thereof. The bottom surface of the replenisher stock tank 56B is penetrated by one end of a supply pipe 92B, to which a pump 95B is disposed in an intermediate portion thereof.

The other ends of supply pipes 92A and 92B are disposed above the opening of a replenishment tank 42A which is disposed adjacent to and communicates with the bleaching/fixing tank 42. The pumps 95A and 95B disposed in the middle of the supply pipes 92A and 92B are electrically connected to the control circuit 88. The pumps 95A and 95B are driven in response to designations from the control circuit 88 so as to supply the component agents 95A and 95B stored in the replenisher stock tanks 56A and 56B to the replenishment tank 42A.

Further, the bottom surface of the replenishment tank 42A is penetrated by one end of a circulation pipe 96, to which a pump is disposed in an intermediate portion thereof. The other end of the circulation pipe 96 penetrates the bottom surface of the bleaching/fixing tank 42. When the pump is driven, the processing solution circulates between the bleaching/fixing tank 42 and the replenishment tank 42A. The replenishment tank 42A is provided with a heater 42B. The processing solution in the replenishment tank 42A is heated by the heater 42B so as to maintain the temperature of the processing solution at a predetermined temperature.

Next, the operation of the present embodiment will be explained with reference to the flowchart of FIG. 5.

Figure 5:
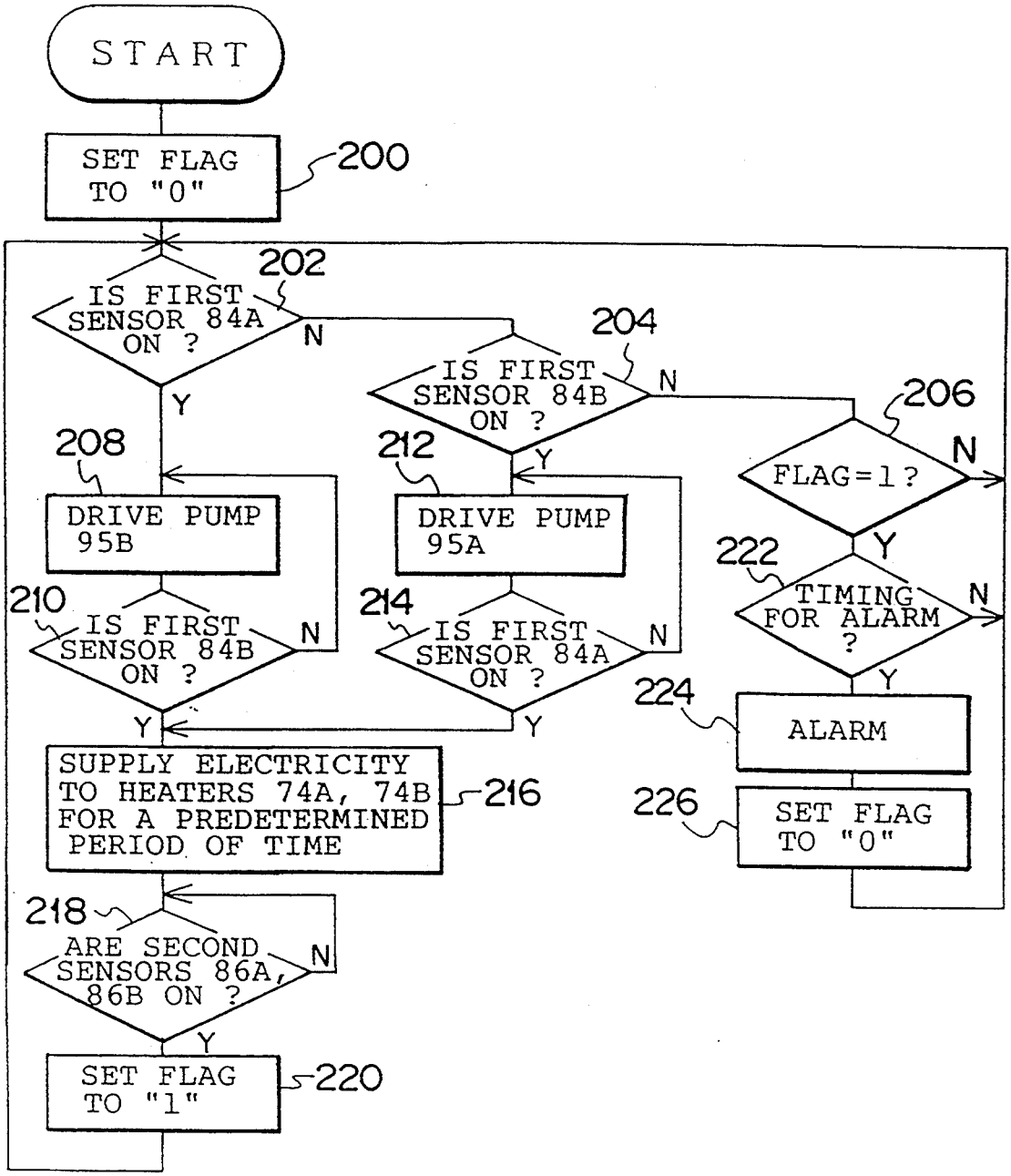
FIG. 5 is a flowchart showing an operation of the present embodiment.

When electricity is supplied to the printer processer 30, operation according to the flowchart of FIG. 5 is executed, and an area for a flag provided in an unillustrated memory is initially set to "0" in step 200.

In the initial state after the supply of electricity, the replenisher stock tanks 56A and 56B are for the most part filled up with the component agents A and B. Further, the cartridge tank 66 is attached to the holder members 76 of the replenisher stock tanks 56A and 56B. In detail, the cartridge 66A filled with the component agent A is attached to the holder member 76 of the replenisher stock tank 56A, while the cartridge 66B filled with the component agent B is attached to the holder member 76 of the replenisher stock tank 56B. The covers 72 of the cartridges 66A and 66B are pushed against the heat generating portions 94 of a ring-like shape of the heaters 74A and 74B with a predetermined force under the condition that the cartridges 66A and 66B are attached to the respective holder members 76.

After the completion of the process in step 200, the process moves to step 202. Here, it is judged whether the first liquid level sensor 84A attached to the replenisher stock tank 56A is turned on. When the result of judgment in step 202 is negative, it is judged in step 204 whether the first liquid level sensor 84B attached to the replenisher stock tank 56B is turned on. When the result of the judgment in step 204 is negative, it is judged in step 206 whether the above-mentioned area for the flag has been set to "1". When the result of judgment in step 206 is also negative, the process moves back to step 202 so as to repeat the processes in steps in 202 to 206 until an affirmative judgment is obtained in step 202 or 206.

While the judgments in steps 202 and 206 are repeated, the photographic printing paper P is continuously subjected to a series of developing processes in the plural processing tanks. During developing processing, a replenisher or the component agents are supplied to the respective processing tanks. The quantities of the component agents A and B supplied to the bleaching-/fixing tank 42 is determined by the control circuit 88 depending on the area of the photographic printing paper which has been processed. The pumps 95A and 95B are driven at predetermined timings, so that predetermined amounts of the component agents A and B are pumped out from the replenisher stock tanks 56A and 56B to be supplied to the bleaching/fixing tank 42 via the supply pipes 92A and 92B and the replenishment tank 42A.

As explained above, the component agent A and the component agent B are separately filled in the cartridges 66A and cartridges 66B of the cartridge tank 66, respectively, and are separately stored in the replenisher stock tank 56A and the replenisher stock tank 56B. Accordingly, it becomes possible to prevent the occurrence of possible drawbacks such as the precipitation of partial components of the component agents, whereby the respective component agents are reserved under stable conditions.

As the component agents A and B are supplied to the bleaching/fixing tank 42. The levels of the component agents A and B lower. Since there exists difference in the capacity of the pumps 95A and 95B, the levels of the component agents A and B lower at different speeds. For example, in a case where the capacity of the pump 95A is slightly higher than that of the pump 95B, the quantity of the component agent A in the replenisher stock tank 56A decreases faster compared to the component agent B so that the component agent A becomes insufficient and the first liquid level sensor 84A is turned on.

Accordingly, the result of the judgment in step 202 becomes affirmative, and the drive of the pump 95B is started in step 208. Accordingly, the component agent B stored in the replenisher stock tank 56B is compulsorily supplied to the replenishment tank 42A. In the next step 210, it is judged whether the first liquid level sensor 84B attached to the replenisher stock tank 56B is turned on. When the result of the judgment in step 210 is negative, the process moves back to step 208 to continuously drive the pump 95B until the first liquid level sensor 84B is turned on. That is, until the liquid levels in the replenisher stock tanks 56A and 56B coincide with each other. When the first liquid level sensor 84B is turned on, the result of the judgment in step 210 becomes affirmative, and the process moves to step 216 accordingly.

On the contrary, in a case in which the capacity of the pump 95B is slightly higher than that of the pump 95A, the quantity of the component agent B in the replenisher stock tank 56B decreases faster compared to the component agent A so that the component agent B becomes insufficient and the first liquid level sensor 84B is turned on. In such a case, the result of the judgment in step 204 becomes affirmative, and the pump 95A is driven by the process in steps 212 and 214 until the first liquid level sensor 84A is turned on, so that the component agent A is compulsorily supplied to the replenishment tank 42A until the liquid levels in the replenisher stock tanks 56A and 56B coincide with each other. When the first liquid level sensor 84A is turned on, the result of the judgment in step 214 becomes affirmative, and the process moves to step 216 accordingly.

In step 216, electricity is supplied to the heaters 74A and 74B for a predetermined period of time. Accordingly, the temperature of the heat generating portions 94 of the heaters 74A and 74B is elevated to a high temperature, whereby the covers 72 of the cartridges 66A and 66B are fused so that holes of a ring-like shape are formed therein. Accordingly, the component agent A in the cartridge 66A and the component agent B in the cartridge 66B flow down to the replenisher stock tanks 56A and 56B through the down-flow pipes 80.

At this time, the component agents A and B flowing down from the corresponding cartridges reach the bottom surfaces of the replenisher stock tanks 56A and 56B. However, since the floating covers 82 float on the surfaces of the component agents A and B in the replenisher stock tanks 56A and 56B, as shown in FIG. 3, drops of component agents A and B are prevented from dispersing from the component agents due to the downward flow of the component agents A and B. This in turn prevents drops of the agents A and B from adhering to the inner walls of the replenisher stock tanks 56A and 56B and precipitating there.

In next step 218, it is judged whether or not both of the second liquid level sensors 86A and 86B are turned on. When all of the component agents A and B in the cartridges 66A and 66B have flown down to the replenisher stock tanks 56A and 56B, the level of the agents A and B in the replenisher stock tanks 56A and 56B increase, and the second liquid level sensors 86A and 86B are finally turned on. The state in which the second liquid level sensors 86A and 86B are turned on means the state in which both the cartridges 66A and 66B are empty. Accordingly, the condition in which the cartridges 66A and 66B are empty is memorized by setting the flag to "1" in step 220, and the process thereafter goes back to step 202.

Since the flag has been set to "1", the result of judgment in step 206 becomes affirmative, and the processing moves to step 222. In step 222, it is judged whether it is the proper timing to activate the alarm 90.

The timing for activating the alarm 90 is a timing at which the continued work is not obstructed, for example, a time after daily operation, or a time when the processing apparatus is in a warming-up mode after being turned on, or a time when operation is temporarily stopped in the middle of the operation. When the result of the judgment in the step 222 is affirmative, the alarm 90 is activated in step 224 to instruct an operator to exchange the empty cartridge 66 with a new cartridge 66 which is filled with component agents. The process then moves back to step 202 via the step 226 in which the flag is reset to "0".

As described above, when the insufficiency of one of the two kinds of component agents A and B which are supplied to the bleaching/fixing tank 42 is detected, the other component agent is compulsorily supplied to the replenishment tank 42A, and the component agents A and B filled in the cartridges 66A and 66B are entirely supplied to the replenisher stock tanks 56A and 56B. Therefore, both cartridges 66A and 66B become empty, which allows the operator to exchange the cartridges 66A and 66B at the same time. This reduces the frequency of exchange operations of the cartridges so that work efficiency is increased.

Further, since the cartridges 66A and 66B are exchanged at the same time, the cartridges 66A and 66B can be integrally formed as a cartridge tank 66. Therefore, the cartridge 66A and cartridge 66B can be exchanged by a single action.

Although the present embodiment has been explained with using the component agent A containing an iron (III) complex of aminopolycarboxylic acid and the component agent B containing thiosulfate, both of which are supplied to the bleaching/fixing tank 42, the present invention, however, is not limited to the same. The present invention can be applied to other component agents, for example, a component agent containing color developing main agent of a p-phenylenediamine type and a component agent containing potassium carbonate, both of which are supplied to the color developing tank 38.

Moreover, in the present embodiment, an example of control has been explained in which the timings of exchanging the cartridges 66A and 66B, which are filled with the component agent A and component agent B to be supplied to the bleaching/fixing tank 42, coincide with each other. The present invention, however, is not limited to the same. The control may be carried out in such a way that the cartridges, which are filled with various replenishers to be supplied to plural processing tanks, coincide with each other. For example, in a case in which the color developing tank 38 is supplied with a replenisher in accordance with the amount of the photographic printing paper P which has been processed, similar to the bleaching/fixing tank 42, the quantity of the replenisher supplied to the color developing tank 38 and the quantity of the replenishers (component agents A and B) have a constant ratio. Accordingly, if the cartridges 65, 66A and 66B are filled with the corresponding replenishers in amounts corresponding to the ratio, and carries out the control as mentioned in the present embodiment, the timings for exchanging the cartridges can be coincided among them.

Although the present invention is applied to the printer processor 30 in the above-mentioned embodiment, the present invention is not limited to the same. The present invention can applied to photographic processing apparatus such as a film processor, and other processing apparatus in which processing is carried out using plural kinds of processing solutions, and replenishers are replenished to the processing solutions at predetermined timings.

Although the empty condition of one of the cartridges is detected by the second liquid level sensors in the above embodiment, such a condition may be detected by using the first liquid level sensors only without the use of the second liquid level sensors. For example, it is possible to set the flag to "1" when a predetermined period of time (corresponding to a time length necessary for component agents in the cartridges to entirely flow downward to the stock tanks) has elapsed after one of the first liquid sensors detects that the level of corresponding agent reaches the predetermined level.

Further, the structure of the replenisher supplying apparatus 54 in the vicinity of the holder member 76 may be modified as follows, in which the same components as in the above embodiment bear the same reference, and explanations thereof will be omitted.

Figure 6:
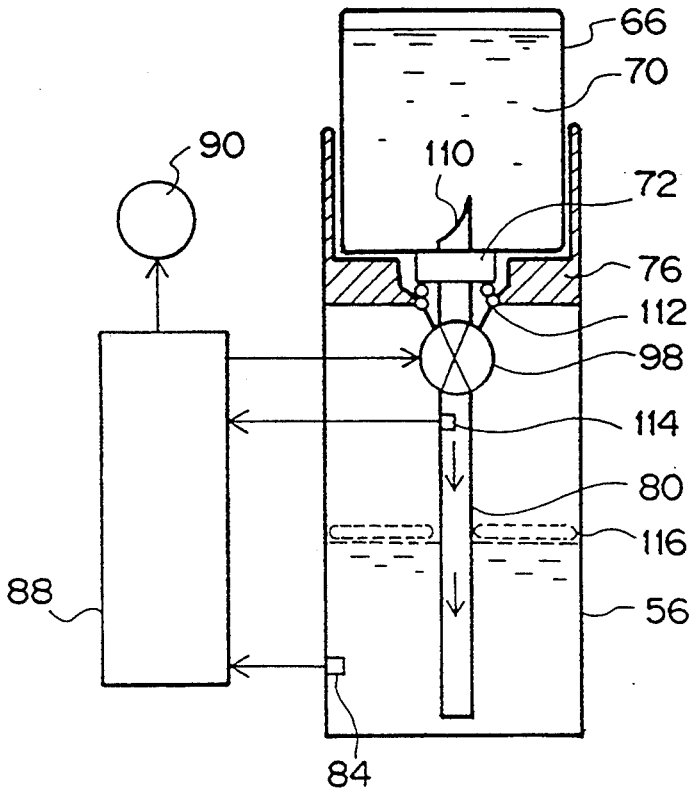
FIG. 6 is a sectional view showing a replenisher stock tank of the replenisher supplying apparatus according to another example.

In a replenisher supplying apparatus shown FIG. 6, a down-flow pipe 80 is formed at its end adjacent to the holder member 76 with a sharp end portion 110 having a cut edge. A valve 98 is disposed in an intermediate portion of the down-flow pipe 80. A hole in the holder member 76, through which the down-flow pipe 80 penetrates, is provided with an O-ring 112 seal for sealing. A passage detection sensor 114 is attached to the inner wall of the down-flow pipe 98 at the downstream side of the valve 98 so as to detect the passing of a component agent. The valve 98 and the passage detection sensor 114 are electrically connected to the control circuit 88. Further, on the surface of the component agent in the replenisher stock tank 56, a number of floats 116 having a function similar to that of the floating cover 82, float under the condition that they make contact each other.

In the example shown in FIG. 6, the cartridge 66 is mounted on the holder member 76 under the condition that the valve 98 is closed. At this time, the sharp end portion 110 of the down-flow pipe 80 ruptures the cap 72 of the cartridge 66 and penetrates the same. Accordingly, the component agent 70 in the cartridge 66 enters the sharp end portion 110 of the down-flow pipe 80 which has penetrated the cap 72, and then flows down to the upstream side of the valve 98. When it is detected by the first liquid level sensor 84 that the level of the component agent 70 in the replenisher stock tank 56 reaches the predetermined level under the above-mentioned condition, the valve 98 is opened in response to a signal from the control circuit 88, so that the component agent 70 in the cartridge 66 flows down through the down-flow pipe 80 to be supplied to the replenisher stock tank 56. At this time, the component agent flowing downward is detected by the passage detection sensor 114. When the passage detection sensor 114 does not detect the passing of the component agent even if the valve 98 is in an opened state, it is judged that the whole of the component agent in the cartridge 66 has flowed down into the replenisher stock tank 56. In such a case, an alarm is activated indicating the need exchange the empty cartridge.

Figure 7:
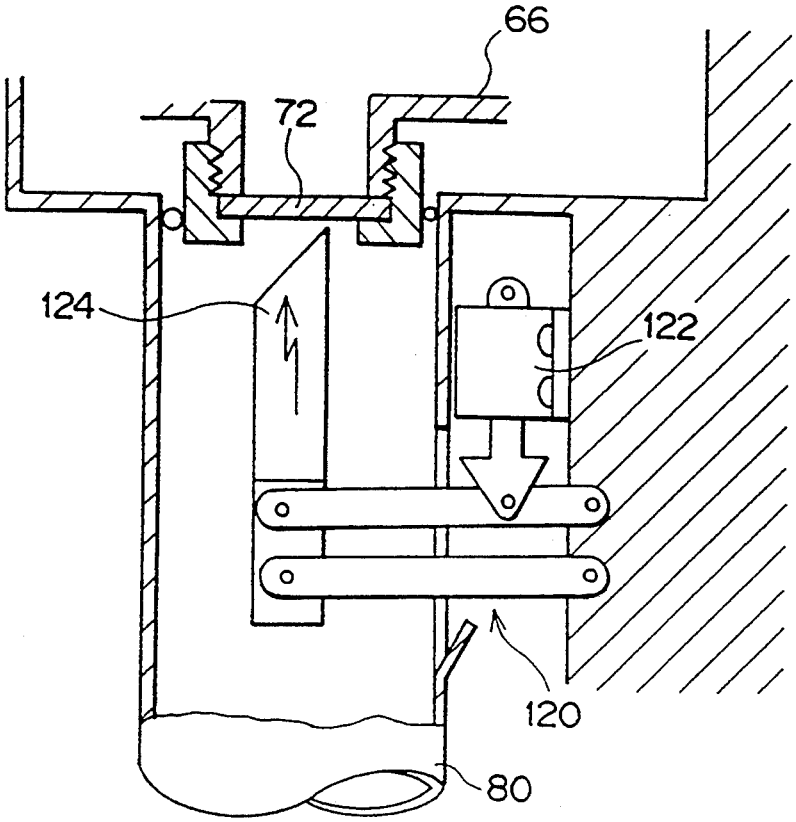
FIG. 7 is a schematic view showing another example of a hole forming mechanism.

In a replenisher supplying apparatus shown in FIG. 7, a hole-forming mechanism, instead of the heater 74, is provided so as to make a component agent in the cartridge 66 flow downward to the replenisher stock tank 56 in a manner similar to that using the heater 74.

The replenisher supplying apparatus is provided with a parallel link mechanism 120 one end of which penetrates the side wall of the down-flow pipe 80 so as to protrude inside the down-flow pipe 80. Attached to the end of the parallel link mechanism 120 located inside the down-flow pipe 80 is a hole-forming blade 124, whose end closer to the cartridge 66 is sharpened to form a cutting edge thereon. To the other end of the parallel link mechanism 120 opposite to the hole-forming blade 124, a movable portion of an actuator 122 having an electromagnetic solenoid is connected.

In the example shown in FIG. 7, when the actuator 122 is driven, the hole-forming blade 124 is moved toward the cap 72 of the cartridge 66 by the parallel link mechanism 120. With this movement, a hole is formed in the cap 72. By moving the hole-forming blade 124 at timings similar to those in the case of using the heater 74 so as to form a hole in the cap 72, the component agent in the cartridge 66 flows downward to the replenisher stock tank 56.

Figure 8:
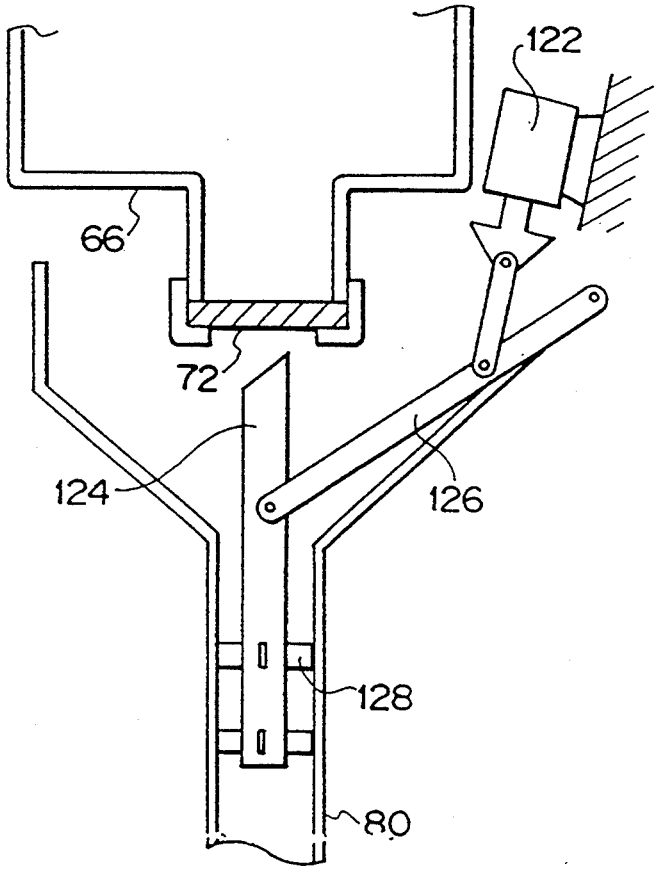
FIG. 8 is a schematic view showing still another example of the hole forming mechanism.

FIG. 8 shows a further modification in the replenisher supplying apparatus shown in FIG. 7, in which a lever 126 is utilized instead of the parallel link mechanism shown in FIG. 7. In the example shown in FIG. 8, a base portion of a hole-forming blade 124 is inserted into the down-flow pipe 80, while a supporting portion 128 is attached to the base portion of the hole-forming blade 124. The hole-forming blade 124 is thereby guided for movement along the down-flow pipe 80.

In the above description, examples are referred in which a component agent in the stock tank is caused to flow downward into a corresponding stock tank by making a hole in the cap of the cartridge by fusing or cutting the cap. However, it is possible to provide a cap which is screwed on a supply opening of the cartridge. The screw engagement of the cap with the cartridge is released by rotating the cap with a motor in order to make the component agent to flow down.

Further, in the above, a condition in which one of the cartridges becomes empty is detected by the second liquid level sensors. However, a switch may be inserted between the cartridge and the holder member, which is turned on when the weighs of the cartridge decreases to be equal or less than a predetermined value. The condition in which the cartridge becomes empty may be detected by the switch. Moreover, although the exchange of cartridges are informed by activating an alarm, the exchange of cartridges may be informed by displaying characters or the like on a display, lighting a lamp, or similar measures.

Furthermore, the component agents may be supplied from the respective stock tanks directly to the processing tank, or supplied to the processing tank after the component agents have previously been blended in a tank which is separated from the processing tanks. Also, the component agents may be blended by a static mixer in the middle of the path for supply by the supplying means (for example, in the middle of supply pipes).

As explained above, the replenisher supplying method and the replenisher supplying apparatus according to the present invention provide the excellent effect of reducing the frequency of exchange operation of the cartridges, thereby increasing work efficiency.

Further, according to the present invention, it becomes possible to reduce variations in photographic characteristics (for example, sensitivity, gradation and the like) even though differences exist in the capacity of the pumps which are provided for plural cartridges, while increasing work efficiency.

What is claimed is:

1. A method of supplying a replenisher to a processing tank by supplying thereto plural kinds of component agents which form the replenisher, said method comprising the steps of:

setting a plurality of cartridges above a plurality of stock tanks for storing said plural kinds of component agents said cartridges being filled with the component agents to be stored in the stock tanks;

supplying, when the quantity of a component agent stored in one of the stock tanks decreases to a level equal to or less than a first predetermined level, a component agent stored in another of the stock tanks to the processing tank until the quantity of the component agent stored in said another stock tank decreases to a level equal to or less than a second predetermined level; and establishing communication between each of the stock tanks and the corresponding one of the cartridges set above the stock tank so that the component agents filled in the cartridges are supplied to the stock tanks.

2. A method of supplying a replenisher according to claim 1, wherein said plural kinds of component agents include a component agent containing an iron (III) complex of aminopolycarboxylic acid and a component agent containing thiosulfate.

3. A method of supplying a replenisher according to claim 1, wherein said plural kinds of component agents include a component agent containing a color developing main agent of p-phenylenediamine type and a component agent containing potassium carbonate.

4. A method of supplying a replenisher according to claim 1, wherein a state in which the quantity of one of said component agents stored in one of the stock tanks has decreased to a level equal to or less than the corresponding predetermined level is detected by a liquid level sensor which detects the height of the surface of said component agent so as to supply another one of said component agents stored in another stock tank to the processing tank until the quantity of said another stock tank decreases to a level equal to or less than the corresponding predetermined level.

5. A method of supplying a replenisher according to claim 1, wherein communication between each of the stock tanks and the corresponding one of the cartridges set above the stock tank is established by melting a meltable portion of each cartridge by a heater so as to supply the component agents filled in said cartridges to said stock tanks.

6. A method of supplying a replenisher according to claim 1, wherein communication between each of the stock tanks and the corresponding one of the cartridges set above the stock tank is established by opening a valve disposed between each stock tank and each cartridge so as to supply the component agents filled in said cartridges to said stock tanks.

7. A method of supplying a replenisher according to claim 1, wherein communication between each of the stock tanks and corresponding one of the cartridges set above the stock tank is established by forming a hole in a hole-formable portion of each cartridge so as to supply the component agents filled in said cartridges to said stock tanks.

8. A method according to claim 1, wherein said establishing communication step further comprises the step of directly controlling said communication with a control circuit.

9. A method of supplying a replenisher according to claim 1, wherein the entire amounts of the component agents filled in said cartridges are supplied to the stock tanks.

10. A replenisher supplying apparatus comprising:

a plurality of cartridges filled with plural kinds of component agents which are to be blended to prepare a replenisher for being supplied to a processing tank;

a plurality of stock tanks for storing the plural kinds of component agents, respectively, above which the cartridges are set, each of the cartridges being filled with a component agent to be stored in the corresponding one of said stock tanks;

a plurality of supply means provided for the respective stock tanks for supplying the component agents stored in the respective stock tanks to a processing tank;

communication means for establishing communication between each of the stock tanks and the corresponding one of the cartridges set above the stock tank so that the component agents filled in the cartridges are supplied to the stock tanks;

detection means for detecting whether the quantity of each of the component agents stored in respective stock tanks has decreased to a level less than or equal to a corresponding predetermined level; and control means for operating, at a time when said detection means detects that the quantity of a component agent stored in one of the stock tanks has decreased to a level less than or equal to the corresponding predetermined level of said one of the stock tanks, one of said supply means so as to reduce the quantity of a component agent stored in another stock tank to a level less than or equal to the corresponding predetermined level of said another stock tank, and for operating said communication means so as to supply the component agents to the stock tanks.

11. A replenisher supplying apparatus according to claim 10, wherein said plurality of cartridges set above said plurality of stock tanks are integrally formed.

12. A replenisher supplying apparatus according to claim 10, wherein said plurality of cartridges are each formed to have the same capacity.

13. A replenisher supplying apparatus according to claim 10, wherein said detection means is comprised of liquid level sensors for detecting the heights of the surfaces of said component agents.

14. A replenisher supplying apparatus according to claim 10, wherein said plurality of supply means are comprised of pumps respectively connected to said control means, and when the quantity of a component agent stored in one of the stock tanks has decreased to a level less than or equal to the corresponding predetermined level of said one of the stock tanks, one of the pumps is operated so as to reduce the quantity of a component agent stored in another stock tank to a level less than or equal to the corresponding predetermined level of said another stock tank.

15. A replenisher supplying apparatus according to claim 10, wherein said communication means is comprised of a meltable portion formed on each of said cartridges and heaters, communication between each of the stock tanks and the corresponding one of the cartridges set above the stock tank being established by melting the meltable portion of the cartridge by the heaters so as to supply the component agents filled in said cartridges to said stock tanks.

16. A replenisher supplying apparatus according to claim 10, wherein said communication means is comprised of a valve disposed between each of said stock tanks and the corresponding one of said cartridges, communication between each of the stock tanks and the corresponding one of the cartridges set above the stock tank being established by opening the valve so as to supply the component agents filled in said cartridges to said stock tanks.

17. A replenisher supplying apparatus according to claim 10, wherein said communication means is comprised of a hole-formable portion formed on each of said cartridges and a hole-forming blade for each of said cartridges, communication between each of the stock tanks and corresponding one of the cartridges set above the stock tank being established by forming a hole in the hole-formable portion of the cartridge by the corresponding one of said hole-forming blades so as to supply the component agents filled in said cartridges to said stock tanks.

18. A replenisher supplying apparatus according to claim 10, wherein said communication means comprises pipes for allowing the component agents to flow from said cartridges toward the bottom surfaces of said stock tanks.

19. A replenisher supplying apparatus according to claim 10, wherein said control means is comprised of a control circuit to which said plurality of supply means and said detection means are electrically connected, and when the detection means detects that the quantity of a component agent stored in one of the stock tanks has decreased to a level less than or equal to the corresponding predetermined level of said one of the stock tanks, the control circuit operates one of said supply means so as to reduce the quantity of a component agent stored in another stock tank to a level less than or equal to the corresponding predetermined level of said another stock tank.

20. A replenisher supplying apparatus according to claim 19, wherein said detection means is comprised of liquid level sensors for detecting the heights of the surfaces of said component agents, said plurality of supply means are comprised of pumps electrically connected to said control means, respectively, and when one of said liquid level sensors detects that the quantity of a component agent stored in one of the stock tanks has decreased to a level less than or equal to the corresponding predetermined level of said one of the stock tanks, the control means operates one of said pumps so as to reduce the quantity of the component agent stored in another stock tank to a level less than or equal to the corresponding predetermined level of said another stock tank.

21. A replenisher supplying apparatus according to claims 10, wherein the entire amounts of the component agents filled in said cartridges are supplied to the stock tanks.

* * * * *